United States Patent [19]

Benson

[11] 4,229,109

[45] Oct. 21, 1980

[54] SYSTEM FOR PRODUCING BITUMINOUS PAVING MIXTURES

[75] Inventor: Bernard A. Benson, Issaquah, Wash.

[73] Assignee: Boeing Construction Equipment Company, Tukwila, Wash.

[21] Appl. No.: 899,385

[22] Filed: Apr. 24, 1978

[51] Int. Cl.[3] ..... B28C 1/22; B28C 5/46

[52] U.S. Cl. ..... 366/24; 366/147; 432/14

[58] Field of Search ..... 366/24, 25, 147, 149; 34/136; 432/14

[56] References Cited

U.S. PATENT DOCUMENTS

| | | | |
|---|---|---|---|
| Re. 29,496 | 12/1977 | Dydzyk | 366/25 |
| 2,487,887 | 11/1949 | McEachran | 366/24 X |
| 2,715,517 | 8/1955 | Bojner | 366/25 X |
| 3,824,065 | 7/1974 | Thompson | 432/14 |
| 3,832,201 | 8/1974 | Shearer | 366/147 X |
| 3,845,941 | 11/1974 | Mendenhall | 366/24 |
| 4,034,968 | 7/1977 | Mendenhall | 366/25 |
| 4,039,171 | 8/1977 | Shearer | 366/144 X |
| 4,074,894 | 2/1978 | Mendenhall | 366/25 |
| 4,082,498 | 4/1978 | Offergeld | 432/14 |
| 4,130,364 | 12/1978 | Brown | 366/25 |

*Primary Examiner*—Billy S. Taylor

*Attorney, Agent, or Firm*—J. Peter Mohn

[57] ABSTRACT

A closed loop system which includes (1) a drum mixer, (2) a heat source separate from the drum mixer for producing a heated gas, (3) intake and exhaust ducts which channel, respectively, the gas produced by the heat source to the intake end of the drum mixer, and the gas at the discharge end of the drum mixer back to one intake of the heat source, and (4) a fan for maintaining the flow of gas in the system. The gas produced by the heat source is between 700° F. and 2000° F. when it enters the drum mixer at its intake end from the intake duct. Graded aggregates and a bituminous binder are fed into the drum mixer at its intake end. The graded aggregates are mixed with the bituminous binder, in the presence of the heated gas, by rotational action of the drum mixer. The resulting bituminous paving mixture is discharged at the discharge end of the drum mixer, along with exhaust gas, a portion of which is channeled back to one intake of the heat source by the exhaust duct.

14 Claims, 9 Drawing Figures

Fig. 1
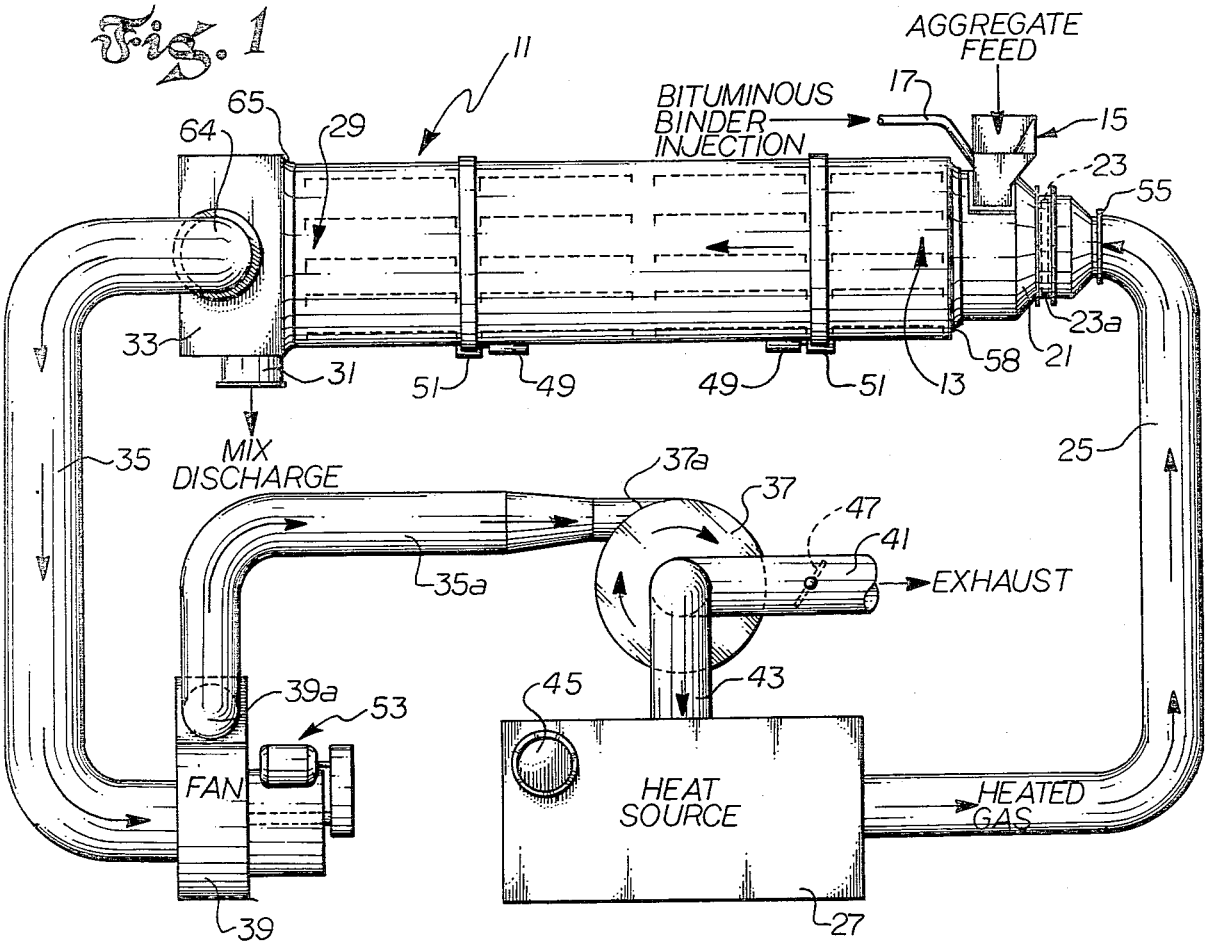
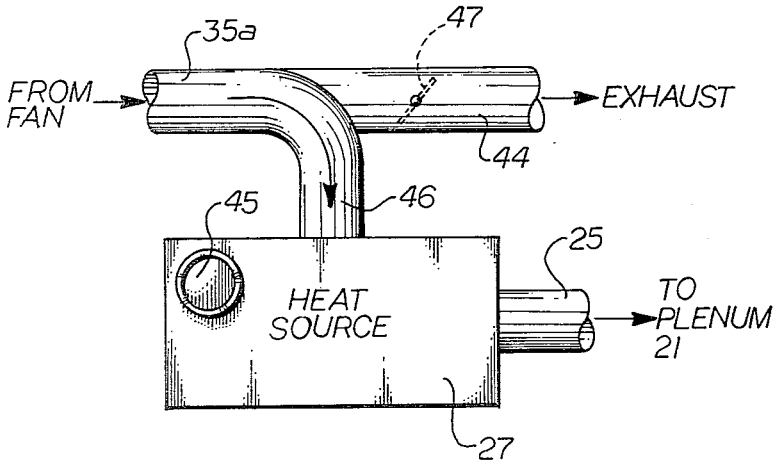
Fig. 2
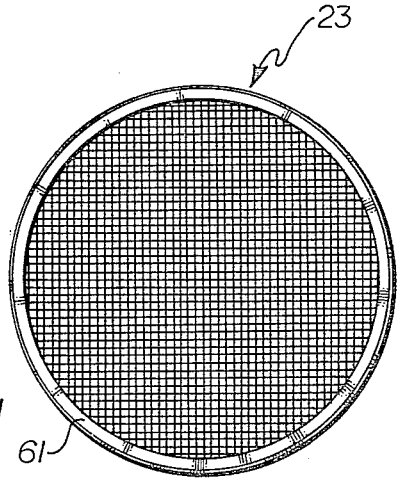
Fig. 3

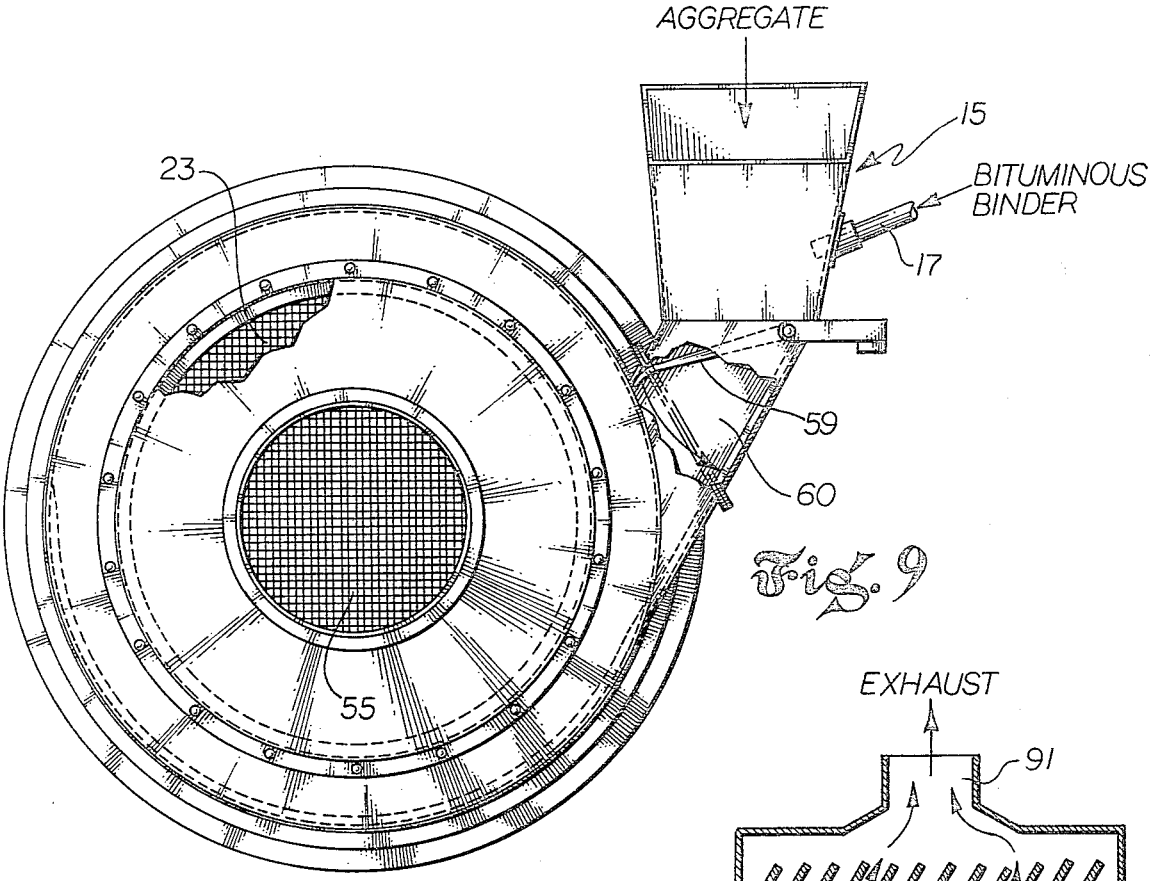
Fig. 9
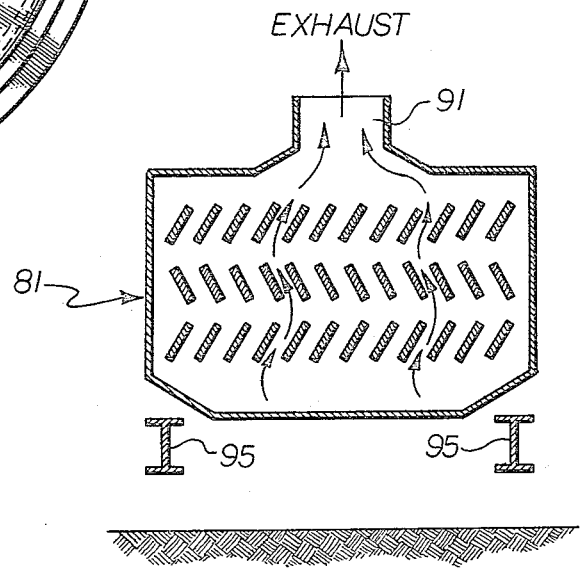
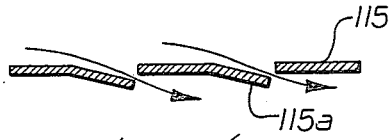
Fig. 6
Fig. 8

SYSTEM FOR PRODUCING BITUMINOUS PAVING MIXTURES

BACKGROUND OF THE INVENTION

This invention relates generally to apparatus for producing bituminous paving mixtures, such as asphalt concrete, and more particularly concerns a closed loop system for producing such mixtures.

Bituminous paving mixtures are produced by combining selected proportions of sized or graded aggregate with a bituminous binder in the presence of relatively high heat. These mixtures, which flow when produced, harden upon cooling to form pavement. In early apparatus, the aggregates were first heated to remove any residual moisture, but new devices, referred to as drum dryer mixers, or just drum mixers, mix unconditioned aggregates and the bituminous binder. The drum mixer has numerous advantages over the older apparatus and has achieved a significant degree of acceptance in the industry. An example of such an apparatus is disclosed in U.S. Pat. No. 3,832,201, issued Aug. 27, 1974, to H. N. Shearer, titled "Process For Making Asphalt Paving Compositions."

A primary concern in the asphalt concrete industry, particularly over the past several years, is the pollution caused by the exhaust of particulates from asphalt plants or drum mixer operations. The particulates or "fines" include the fine aggregates which become airborne in the drum mixer or when the aggregates are being dried, and which are never captured in the mixing process. Particulate volumes as much as 3000 Lbs/hour are not uncommon in the industry, requiring complex systems of pollution control devices downstream of the mixer.

The '201 patent discloses a particular drum mixer arrangement, however, which reduces the amount of exhaust particulates to the point where pollution control equipment is virtually unnecessary. In that particular drum mixer, the graded aggregates and the bituminous binder are added together at the intake end of drum mixer, so that the binder, and later the mixture, captures nearly all the small particulates or fines which would otherwise become airborne and be exhausted from the apparatus.

Although such arrangement substantially reduces the volume of particulates exhausted to the atmosphere, certain disadvantages resulted, due to the proximity of the burner flame to the region of the intake of the bituminous binder. The presence of the flame, resulting in core temperatures as high as 3000° F. in the intake region, and a high heat transfer rate, caused combustion of the bituminous binder and a resulting dense smoke at the exhaust, as well as a decrease in the quality of the mix. In addition, the high heat transfer rates of such devices prevented the recycling of existing bituminous pavement, as such material smokes in such drum mixers when added at the intake region.

In certain drum mixers, the bituminous binder is added downstream of the intake region, which eliminates the combustion of the binder but brings the particulate level up significantly. Other devices, such as those disclosed in U.S. Pat. No. 4,039,171 to H. N. Shearer, titled "Drum Dryer/Mixer", and in U.S. patent application No. 879,407, now U.S. Pat. No. 4,143,972, in the name of Bernard A. Benson, filed Feb. 21, 1978 titled: "Combustion Control System for Bituminous Drum Mixers," both of which are assigned to the assignee of the present invention, attempt to solve this problem. In the mixers disclosed therein, screens or shields are used to modify the thermal effects of the burner flame to the point where the bituminous binder may be added to the intake region. These techniques themselves have disadvantages, however. The screens have a short life, due to the high temperature of the flame, and the shield likewise is not completely satisfactory, again due to the immediate proximity of the burner flame.

In addition, such apparatus for producing bituminous paving mixtures use a great deal of fuel to produce the high temperatures required, and to date, the high temperature gases present at the discharge end of the apparature are exhausted to the atmosphere. A great deal of energy, in the form of heated exhaust gas, is thus lost to the atmosphere, which reduces the overall thermal efficiency of the system. The inefficient use of energy, of course, is becoming increasingly important in this time of scarce resources.

Accordingly, it is a general object of the present invention to provide a system for producing bituminous paving mixtures which overcomes one or more of the disadvantages of the prior art specified above.

It is another object of the present invention to provide such a system which permits mixing of graded aggregates and bituminous binders at the intake end of a drum mixer portion of the system, without resulting in smoking of the binder.

It is a further object of the present invention to provide such a system which has an increased thermal efficiency over existing systems.

It is an additional object of the present invention to provide such a system which does not require additional pollution equipment.

It is a still further object of the present invention to provide such a system in which the heat in the intake region of the drum mixer is substantially equal across the drum mixer.

It is yet another object of the present invention to provide such a system which is capable of recycling bituminous paving mixtures.

SUMMARY OF THE INVENTION

Accordingly, the present invention is a partially closed system which produces bituminous paving mixtures. The system includes a drum mixer which has an intake region and a discharge region. The drum mixer is adapted to receive graded aggregates and a bituminous binder at the intake region and is operable, when fired, to produce bituminous paving mixture at the discharge region. A heat source which is separate from, and spaced apart from, the drum mixer, produces a heated gas at a specified temperature, which gas is directed by a channel or duct to the intake region of the drum mixer. The gas at the intake region of the drum mixer flows down the length of the drum mixer to the discharge region, where a portion of the gas present there is directed back through a channel or duct to the heat source. A device such as a fan is used to maintain the flow of gas through the partially closed system.

DESCRIPTION OF DRAWINGS

A more thorough understanding of the invention may be obtained by a study of the following detailed description taken in connection with the accompanying drawings in which:

FIG. 1 is a generalized, schematic plan view of the system of the present invention.

FIG. 2 is an alternate embodiment of a portion of the system of FIG. 1.

FIG. 3 is a front view of a header plate used with the drum mixer shown in FIG. 1.

FIG. 6 is a section view of a portion of the heat source of FIG. 5.

FIG. 8 is a cross-section view of the apparatus of FIG. 7 taken along lines 8—8.

FIG. 9 is an end view of the drum mixer of FIG. 1, showing the feeding arrangement for the graded aggregates and bituminous binder.

DESCRIPTION OF PREFERRED EMBODIMENT

Figure 4:
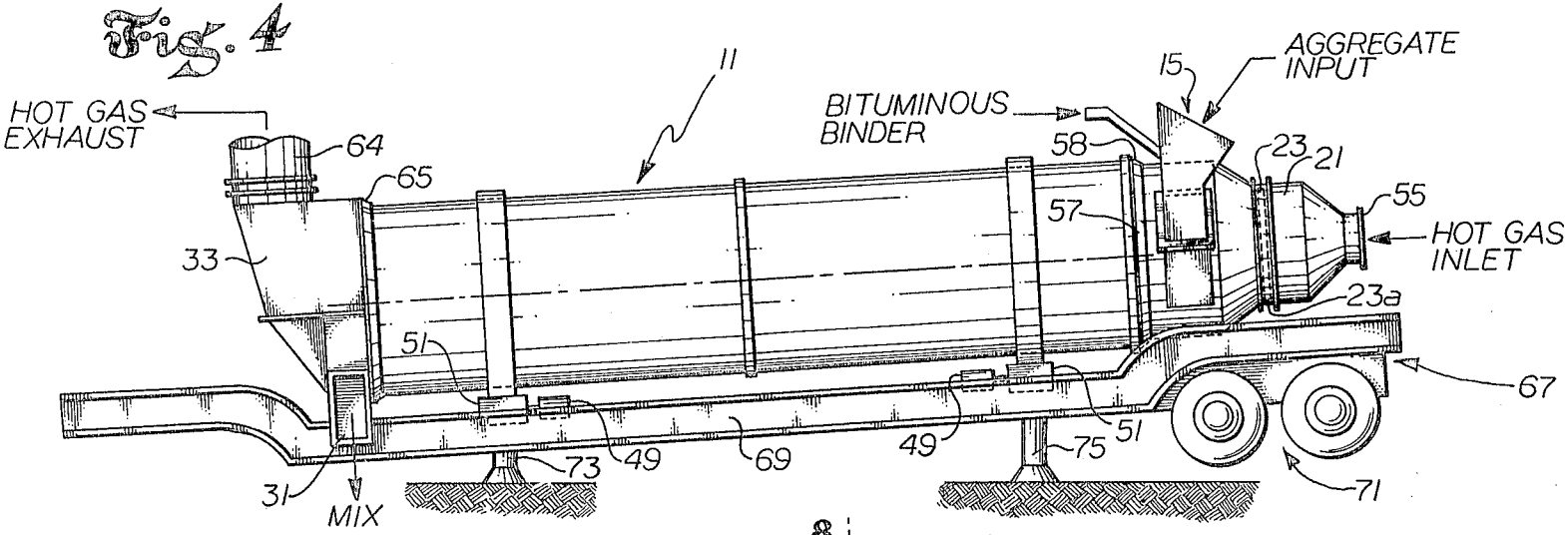
FIG. 4 is a side elevational view of the drum mixer shown in FIG. 1.

The system of the present invention is shown in generalized form in FIG. 1. The drum mixer portion of the system, in which graded aggregates are combined with a bituminous binder and heated to form a bituminous paving mixture, is shown generally at 11. The aggregate and the bituminous binder are fed into the drum mixer in an intake region 13 thereof by a hopper-feeder 15 and a feed tube 17, respectively. The hopper-feeder 15 is controlled by a motor (not shown).

Heated gas from a heat source 27, at a temperature of 700° F.-2000° F., is introduced into intake region 13 through a plenum 21 and a header plate 23, which is positioned adjacent tthe intake end of the drum mixer 11. The heated gas is supplied to plenum 21 through an intake duct line 25 from heat source 27, which is positioned external to drum mixer 11 in the system of the present invention.

The bituminous paving mixture produced by the action of drum mixer 11 is discharged from drum mixer 11 in discharge region 29, through a port 31. An exhaust manifold 33, which surrounds the discharge end of drum mixer 11, carries the exhaust gas from discharge region 29 into an exhaust duct line 35, which channels it to a cyclone separator 37 through fan 39. Fan 39 is positioned, in the embodiment shown, in exhaust duct line 35, to maintain a steady flow of gas throughout the closed system of FIG. 1. It could be positioned, however, if desired, in intake duct line 25.

Cyclone separator 37 is a conventional device which spins the gas delivered to it at high speeds, forcing the remaining particulates in the gas against the wall of the separator, and hence separating the particulates from the gas. A suitable cyclone separator is disclosed in the "Chemical Engineer's Handbook", published by McGraw-Hill, latest edition-1973. A portion of the gas entering the cyclone separator at intake 37*a* through exhaust duct line 35*a*, which may be in the form of steam, is directed to the atmosphere through stack 41 while the remainder is supplied back to heat source 27 through duct 43. Additional air from the atmosphere is supplied through air intake 45 to heat source 27. The relative proportions of gas from separator 37 directed to the atmosphere through stack 41 and directed to heat source 27 through duct 43 is controlled by the position of damper 47 in stack 41.

In operation of the system, air from the atmosphere is introduced into heat source 27 through intake 45, while gas from the system is introduced into heat source 27 through duct 43. The atmospheric air is at atmospheric temperature and is directed into heat source 27 by a fan (not shown) while the system gas is directed into heat source 27 at a temperature of between 250° and 350° and is moving at a velocity of approximately 3000 ft/min. by fan 39. Heat source 27 typically includes a high temperature burner/combustion chamber usually burning fossil fuel, and necessarily has such a capacity that the hot gas produced, which is preferably chemically inert, is at a temperature between 700° F. and 2000° F., although a narrower range of 900° F. to 1500° F. may be preferred in certain applications.

The heated gas from heat source 27, which may, for instance, be a combination of dry steam, nitrogen and carbon dioxide, is directed through intake duct line 25 to plenum 21. Since heat source 27 is separate from plenum 21, there is no flame within or proximate to intake region 13 of drum mixer 11, and hence no combustion occurs within drum mixer 11, which distinguishes the present system from prior art systems. The heated gas in plenum 21 is dispersed by header plate 23 (shown most clearly in FIG. 3) over the area of the intake region, resulting in uniform temperature and velocity profiles across drum mixer 11 at the intake region 13, which results in a heat transfer rate low enough to produce a consistently high quality paving product, and without smoking of the binder.

Graded aggregates and bituminous binder are fed together into drum mixer 11 in the intake region, and the drum mixer is rotated by the combination of an external motor 49 and friction drive arrangement 51. The drive arrangement, whether it be by friction or gearing, is conventional. The aggregates and bituminous binder are then mixed under heat along the length of the drum mixer. The heated gas proceeds lengthwise of the drum/mixer, as does the mixture, because the drum mixer is angled downward from intake to discharge.

At the discharge end of the drum mixer, the bituminous paving mixture is removed from the drum mixer and transported to a temporary storage device, from where it may be loaded onto trucks or the like for use. The exhaust gas present at discharge region 29, which is at a temperature of approximately 250° F. to 350° F., is directed by manifold 33 to exhaust duct line 35, through which gas is channeled to cyclone separator 37 by means of a fan 39 actuated by a motor 53.

With the system of FIG. 1, bituminous paving mixture may be produced in large quantities with very little exhaust particulates or smoke. The thermal efficiency of the system is also quite improved over existing systems, due to the partial feedback of the system exhaust gas to heat source 27.

FIG. 2 shows an alternate embodiment of that portion of the system of FIG. 1 which is located between fan 39 and heat source 27. In the embodiment of FIG. 2, cyclone separator 37 is eliminated, and the exhaust duct 35*a* from fan 39 divides to form an exhaust stack 44 and a duct 46 leading back to heat source 27. Control over the relative proportions of the exhaust gas which are directed to the exhaust stack and to heat source 27 is provided by damper 47 in the exhaust stack, similar to the embodiment shown in FIG. 1.

FIG. 4 shows in more detail the drum mixer 11 used in the system of the present invention. Drum mixer 11 may be various sizes, depending upon the volume of bituminous paving material to be produced. Typically, drum mixer 11 may have a diameter between 5 and 10 feet, and may be between 25 and 40 feet long. This will result in production of between 100 and 600 tons of bituminous paving mixture per hour. Drum mixer 11 is similar in some respects to current drum mixers, although its intake configuration, in particular, includes several significant structural improvements. The heated gas produced by heat source 27 is introduced into plenum 21 from intake duct line 25. Plenum 21 acts essentially as an intake manifold or shroud for the intake end of drum mixer 11.

Plenum 21 is a chamber which increases in diameter from one end 55, which connects with the downstream end of intake duct line 25 to the other end 57 which mates with the leading edge of drum mixer 11 through a seal 58. The plenum 21 may take various configurations, of which the embodiment shown in FIGS. 1, 5 and 9, featuring a center feed for the heated gas, is but one.

The aggregates are supplied to drum mixer 11 by a conventional conveyor (not shown) which feeds the feeder-hopper 15, which is shown in more detail in FIG. 9. The aggregates fall into the feeder-hopper 15 from the head of the conveyor and in one embodiment, are supported initially by a counter weighted platform or paddle 59. The bituminous binder is then added to the aggregates through feed tube 17, and the mixture is fed into the drum mixer when the counter weighted platform drops. Hence, discrete amounts of aggregates and binder are supplied to the drum mixer down the chute 60. The arrangement shown also provides a positive air seal between the drum mixer and the feeder-hopper 15, which is desirable because the more air which is let in by the feeding apparatus, the more fuel is burned, and the more particulate is carried-out to the atmosphere. In the arrangement shown, furthermore, the aggregates and the binder enter the intake region 13 together, on chute 60, which further aids in reducing the amount of airborne aggregate particulates in the drum mixer, leading to a reduction in pollution.

It should be understood, however, that the particular feeding embodiment shown is by way of example, and that other arrangements, such as a vane feeder, could also be used to accomplish the desirable features of positive air-sealing and early mixing of the aggregates and binder.

The heated gas in plenum 21 is supplied to the drum mixer 11 at its intake end through header plate 23. Header plate 23, which is located in region **23*a* of the plenum 21, is shown in more detail in FIG. 3**. It operates as a diffuser plate to even out the flow of the heated gas into the drum mixer, so that the velocity and temperature profiles are substantially uniform across the intake of the drum mixer.

Header plate 23 is circular in outline, relatively thin, and has a rim 61 which mates with the interior surface of plenum 21 in region **23*a***.

Header plate 23 comprises a screen which is sufficiently dense to produce a pressure drop at the plane of the screen of approximately 2 inches of water. Typically, this may be accomplished with a heat resistant screen of approximately 25%–40% open area, comprising $\frac{1}{8}$" diameter wire and a $\frac{3}{8}$" mesh size. Header plate 23 completely fills the cross-sectional area of plenum 21 in region **23*a*, and hence, all of the heated gas in plenum 21 is directed through header plate 23 into drum mixer 11**. The pressure drop at the screen forces the gas to take all possible paths into the drum mixer, which results in a reduction of the ratio of the flow peak velocity to flow mean velocity to just about 1, so that the velocity profile of the gas is substantially uniform. In addition, the temperature profile of the gas is thus also uniform across the intake end of the drum mixer. The uniform velocity and temperature profiles reduce the heat transfer rate in the drum significantly, to the point where the bituminous binder will not smoke. Hence, the binder, as well as recycled material, may be directed into the intake region of the drum mixer, instead of substantially downstream.

With such an arrangement, the aggregates are thoroughly coated by the biuminous binder before the aggregate particulates, or fines, become airborne, which in turn substantially reduces the carry-out volume of particulates. The velocity of the gas flow in the drum mixer, furthermore, can be decreased to less than 2300 feet per minute, without a decrease in production over previous direct flame drum mixers having nonuniform gas flow velocities of over 3000 feet per minute. This decrease in gas velocity further helps in reducing the carry out of particulates.

The heated gas provided to the drum mixer 11 is, as mentioned above, preferably inert, as premature oxidization of the bituminous binder, with resulting damage to the mix, will occur in an active environment. The system of the present invention is designed to insure an inert gaseous environment in the drum mixer.

The interior of the drum mixer is optimized to provide the best mix in the least amount of space. A first longitudinal portion of the drum mixer, relatively small compared to the total length of the drum mixer, has spiral flights in order to get the flow of material straightened out and moving down the length of the drum mixer, which is inclined at an angle of approximately $3\frac{1}{2}°$. The remaining portion of the drum mixer includes several sets of horizontal flights arranged around the inner periphery of the drum. As an example, for an 8 foot drum mixer, there may be 24 horizontal flights in five foot sections along the length of the drum. With such an arrangement, made possible by the early feeding of the bituminous binder, vailing of the mixture begins almost immediately, and the length of the drum mixer need not be as long as was previously required for a given production.

The discharge region 29 of drum mixer 11 includes a plurality of flat, relatively short, vanes arranged around the inner periphery of the drum mixer 11. As the drum mixer turns, the finished product, i.e. the bituminous paving mixture, will come to rest on the vanes and then will exit through port 31 in exhaust manifold 33. The paving mixture discharged through port 31 may then be moved by means of a conveyor or similar device (not shown) to a temporary storage bin, from where it may be dispensed into waiting trucks or other similar devices for transportation to a job. Such an arrangement is conventional and is shown in the '201 patent.

The discharge end of drum mixer 11 is connected to an exhaust manifold or shroud 33 through a seal 65. The manifold 33 forms a chamber to receive system gas from the discharge end of drum mixer 11, and includes an outlet 64 which is connected to the exhaust duct 35. In the embodiment shown, the outlet 64 is on top of the exhaust manifold, but it could be at other locations as well.

The drum mixer 11 shown in FIG. 4 can be made portable through a trailer arrangement shown generally at 67, which comprises a trailer bed 69, on which the drum mixer is supported and a set of wheels 71. When the drum mixer 11 is to be used, supports 73 and 75 may be positioned to provide stable support at the desired angle.

Figure 7:
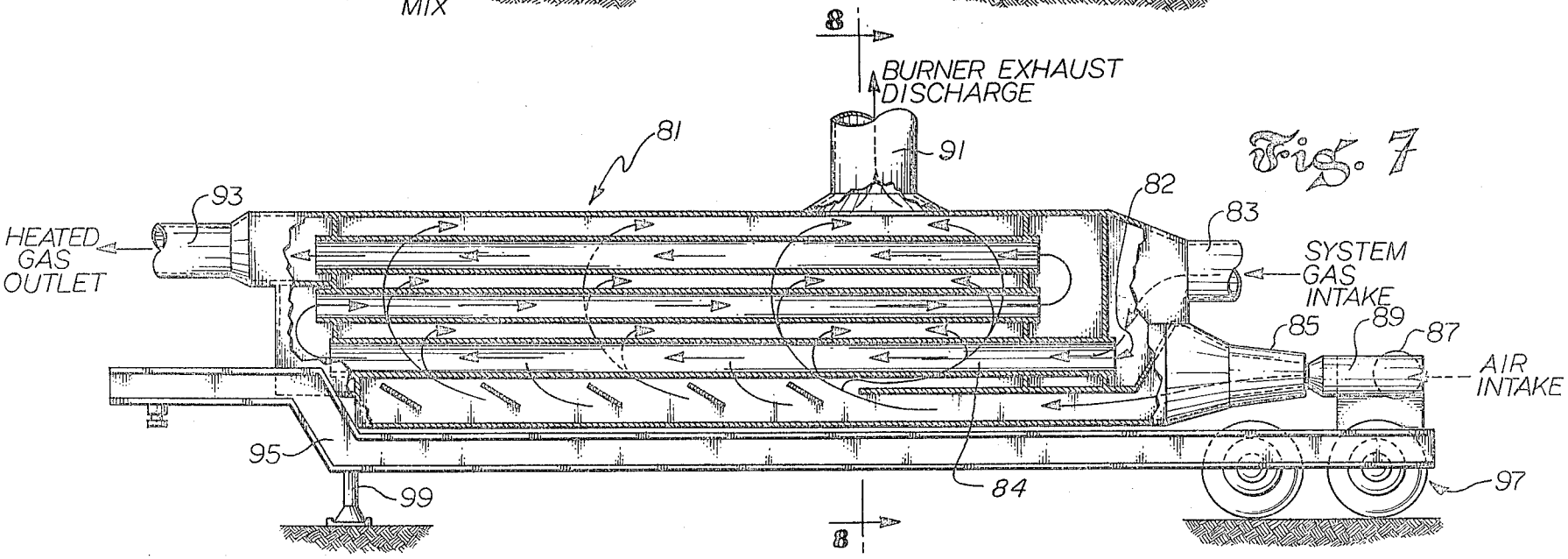
FIG. 7 is an alternate embodiment of the heat source shown in FIG. 1.

As noted above, the heated gas which fires the drum mixer 11 in the embodiment shown is supplied by heat source 27. Although heat source 27 may take various forms, two specific embodiments are disclosed herein. The first embodiment is a gas-to-gas heat exchanger shown in elevational view in FIG. 7 and in cross-sectional view in FIG. 8. The heat exchanger is generally shown at 81 and is substantially longer than its cross-sectional dimension. For instance, the heat exchanger could range from 4–8 feet in width, 5–10 feet in height, and 20–40 feet in length. The particular heat exchanger shown in FIGS. 7 and 8 is a quasi-parallel flow heat exchanger, but other types of heat exchangers, such as one employing counter-flow principles, could be used. Heat exchanger 81 includes a gas intake 83 at one end thereof, through which gas from the exhaust duct line, i.e. duct 43 in FIG. 1, is applied to the heat exchanger, where it is directed to the intake 82 of the duct line 84, which runs back and forth through the heat exchanger and terminates at outlet 93. FIG. 8 shows the configuration of the duct line 84 most clearly.

Atmospheric air is directed to a fossil fuel burner 85 through intake 87 by means of a fan (not shown). The combustion gas produced by the burner 85 is directed over the length of the heat exchanger and upwards from the bottom of the heat exchanger, around the duct line 84, to the top. The energy in the heated combustion gas is transferred to the system gas in duct line 84, heating that gas to the desired 700° F. to 2000° F. temperature. The construction details of such a gas-to-gas heat exchanger may be found in the Chemical Engineer's Handbook, supra.

After flowing over and around the duct line 84, the combustion gas flows through exhaust stack 91 and is vented to the atmosphere. The exhaust from stack 91 is virtually pollution-free and it can be used, if desired, as a secondary heat source in another application. The gas from duct line 84, at 700° F. to 2000° F., is directed through outlet 93 of the heat exchanger, which is connected with intake duct line 25 of the system of FIG. 1.

Heat exchanger 81 can also be made portable through the use of a trailer comprising a trailer bed 95, a set of wheels 97, and supports 99, similar to the trailer apparatus for the drum mixer 11 described above.

Figure 5:
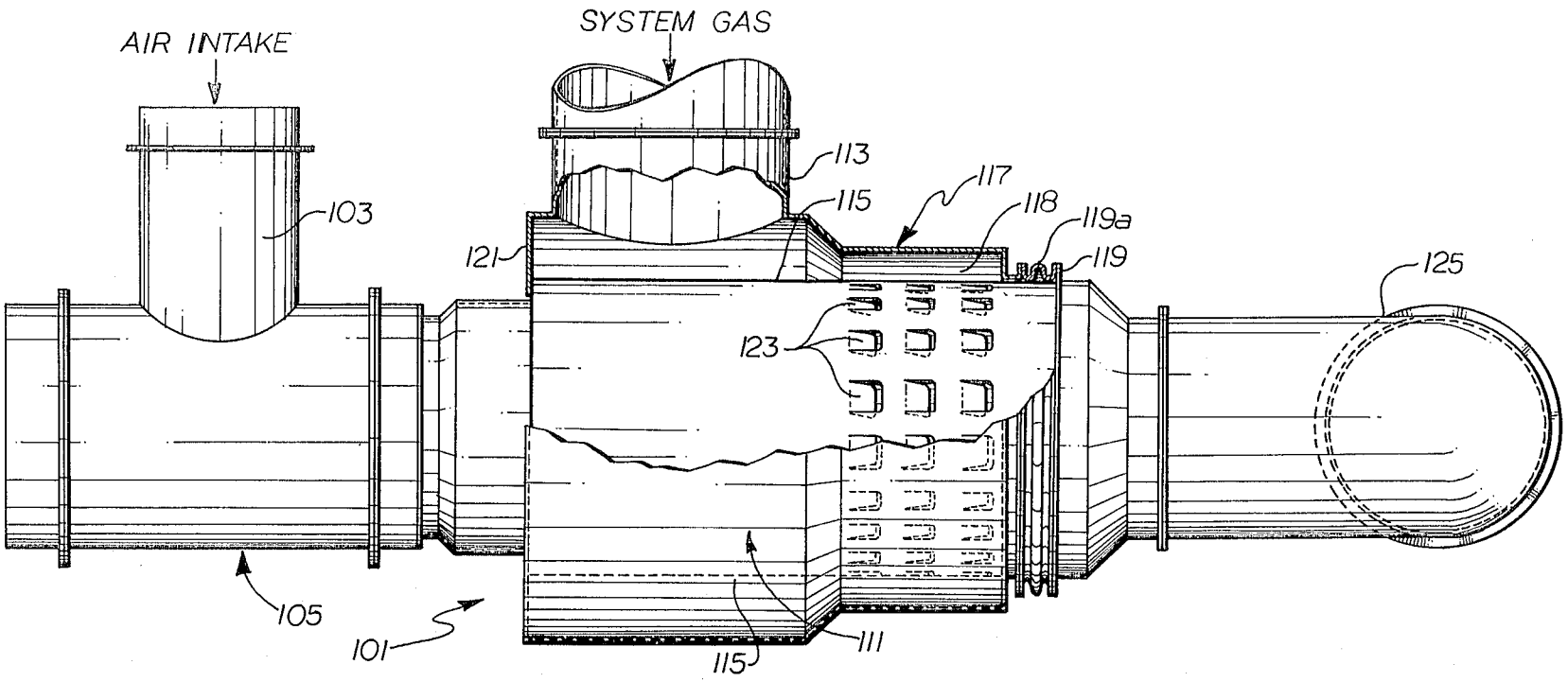
FIG. 5 is a side elevation view of one embodiment of the heat source shown in FIG. 1.

The second embodiment of heat source 27 is shown in elevation view in FIG. 5, while a structural feature of a portion of the device is shown in FIG. 6. Referring to FIG. 5, the embodiment of heat source 27 shown therein is a gas generator referenced generally as 101. Gas generator 101 includes an air intake 103 and an intake fan (not shown) through which air from the atmosphere is taken into the generator 101 at ambient temperature. The air from intake 103 is fed to a conventional fossil fuel burner 105. On the downstream end of burner 105 is a combustion chamber 111. Combustion occurs from the burner through a substantial portion of chamber 111, under near stoichiometric conditions i.e. a balance of air and fuel.

The temperatures in the combustion chamber 111 are quite high, e.g. 3000° F., which would ordinarily be sufficient to melt conventional, non-ceramic combustion chambers. To prevent this, the air from the system, i.e. from duct 43 (FIG. 1) is circulated around the combustion chamber to cool it and to control the interior temperatures to desired levels. Thus the system gas acts as a coolant or a dilution gas in the embodiment of FIG. 5.

A manifold 117 surrounds combustion chamber 111, and located in manifold 117 is an intake 113 through which exhaust gas from the system, i.e. gas from duct 43, is directed. In the embodiment shown, manifold 117 is the same configuration as combustion chamber 111 but has a slightly larger diameter, e.g. 4 feet 8 inches for a four foot combustion chamber, so that a spatial volume 118 exists between manifold 118 and the outer wall 115 of combustion chamber 111. The manifold 117 further has a slightly larger diameter over the circumferential region where the intake 113 is positioned.

The respective ends of manifold 117 are sealed by means of plates 119 and 121 to the outer wall 115 of combustion chamber 111. The end plate 119 is connected to the manifold 117 by a bellows expansion joint 119a, which permits expansion of the volume 118 between manifold 117 and the outer wall 115 of combustion chamber 111 without damaging the sealing relationship between the manifold and the combustion chamber.

Arranged in the outer wall of combustion chamber 111 are a number of slot-like openings 123 which communicate the interior of combustion chamber 111 with spatial volume 118. Hence, the exhaust gas from the system supplied through intake 113 may enter the combustion chamber through openings 123. This aids in the cooling of the combustion chamber and the control of the internal temperature of the chamber.

In the embodiment in FIG. 5, openings 123 are similar to louvers, formed by making shallow U-shaped cuts in the outer wall 115 of combustion chamber 111, and forcing the interior section 115*a* of each U-shaped cut slightly inward of the combustion chamber axis, approximately 10°. The configuration of the openings is shown most clearly in FIG. 6.

The position of the openings and their arrangement, is important to the operation of the system. The openings must be located just forward of the termination point of the combustion flame, so as to not quench the flame. They should be uniformly distributed around the combustion chamber and evenly distributed as well, so as to avoid hot spots. There should be sufficient openings to provide good cooling and dilution, without quenching. Typically, the openings will be spread over an axial length of approximately one-half a diameter of the combustion chamber. The total open area of the openings should be such that there will be from 1–4 inches of water pressure drop experienced by the flowing dilution gas. As an example, for a 4½ foot diameter chamber, 3 rows of 4 inch slots spaced 4 inches apart will provide satisfactory results.

The heated gas in combustion chamber 111, diluted in temperature to the desired range of 700° F. to 2000° F., as explained above, is then directed out of the gas generator 101 through discharge 125, which is connected to intake ductline 25 (FIG. 1). The gas produced by generator 101, is also chemically inert, comprising primarily steam and a few combustion products. The excess system gas not needed to cool the gas in chamber 111 is vented to the atmosphere through exhaust stack 41 (FIG. 1). This exhaust gas is usually in the form of steam.

As an alternative to the exhaust arrangement of FIG. 1, the excess system gas could be vented to the atmosphere downstream of heat source 27, which would result in all of the gas in the system being continually passed through the combustion zone in the heat source, resulting in the elimination of any hydrocarbon residue in the gas flow. This would further reduce pollution but would result in an increase in fuel consumption.

Both of the embodiments shown in FIGS. 5-8 produce a chemically inert gas which is very desirable for proper operation of drum mixer 11. The gas produced by the embodiment of FIGS. 5 and 6 consists of nitrogen, carbon dioxide and water vapor, while the gas produced by the embodiment of FIGS. 7 and 8 consists of primarily water vapor, all of which are inert with respect to the combustion of bituminous material.

The remaining portions of the system, i.e. the intake ductline 25, the exhaust ductline 35, the cyclone separator 37 and the fan 39, are all conventional per se but together with the apparatus described above form the novel closed system of the present invention. The duct lines 25 and 35, in the embodiment shown, comprise cylindrical lengths of sheet metal, approximately 2-3 feet in diameter. In the embodiment shown, the heat source 27 is separated from drum mixer 11 by 20-40 feet of intake duct line. The duct lines may be insulated, if desired to prevent convection heat losses.

In the embodiment shown, intake duct line 25 is uninterrupted from heat source 27 to air plenum 21. In the exhaust duct line 35, however, are located fan 39, cyclone separator 37, and exhaust stack 41. Fan 39 is conventional and is positioned so that the gas in duct line 35 enters laterally of the fan and perpendicular to the blades, and exits through port 39*a* radially of the fan, and parallel to the blades. Fan 39 moves the gas throughout the entire system. The gas from port 39*a* of fan 39 moves into a portion of exhaust duct line 35*a*, which is connected to an input 37*a* of cyclone separator 37. Cyclone separator 37 has two outputs, one connected to exhaust stack 41, and the other to duct 43. The amount of gas in duct 43 is controlled by the position of damper 47 in exhaust stack 41.

The closed loop system of the present invention permits the exhaust gas present at the discharge end of the drum mixer to be recycled through the system, thereby decreasing fuel consumption and increasing thermal efficiency. The system includes a heat source which is external of the drum mixer and a novel plenum/header plate arrangement, which combines to produce both uniform temperature and velocity profiles over the intake region of the drum mixer, which in turn permits the aggregate and the bituminous material to be fed together to the intake region of the drum mixer.

With the system of the present invention, bituminous paving mix may be produced at a high rate, without the need for downstream pollution control systems more sophisticated and costly than a cyclone separator. The present system is capable of recycling bituminous pavement or using a combination of old pavement and new aggregates and bituminous binders, without any modification to the system.

Although a preferred embodiment of the invention has been disclosed herein for purposes of illustration, it will be understood that various changes, modifications and substitutions may be incorporated in such embodiment without departing from the spirit of the invention as defined by the claims which follow.

What is claimed is:

1. A partially closed system for producing bituminous paving mixtures comprising:

drum mixer means having an intake region in the vicinity of one end thereof and a discharge region in the vicinity of the other end thereof, said drum mixer means being operable, when fired, to produce a bituminous paving mixture at said discharge region;

means for introducing graded aggregate into said drum mixer means at said intake region;

means for introducing a bituminous binder into said drum mixer means at said intake region;

plenum means disposed at said intake region and arranged to substantially enclose the end of said drum mixer means at said intake region, the interior of said plenum means being open to the interior of said drum mixer means;

exhaust manifold means disposed at said discharge region and arranged to substantially enclose the end of said drum mixer means at said discharge region;

heating means, spaced apart from said drum mixer means, for producing a heated gas having a temperature in the range of 700 to 2000 degrees Fahrenheit;

said heating means comprising a burner, a combustion chamber having an outer periphery within said heating means and a heating means manifold substantially surrounding said combustion chamber;

said burner being arranged to produce an open flame for direction into said combustion chamber for a portion of the length thereof;

sealing means for sealing the ends of said heating means manifold to the outer peripheral surface of said combustion chamber;

said combustion chamber having a plurality of slot-like openings in at least a portion of its peripheral surface for permitting gas from said heating means manifold to pass into said combustion chamber through said openings;

first channeling means for receiving heated gas from said heating means and directing said heated gas to the interior of said plenum means;

second channeling means communicating with the interior of said exhaust manifold for directing a selected portion of exhaust gases within said exhaust manifold to the interior of said heating means manifold;

means for maintaining a flow of heated gas throughout said partially closed system.

2. An apparatus of claim 1, including header plate means positioned within said plenum means for dispersing the heated gas from said first channeling means in such a manner that the velocity profile of the heated gas over said intake region is substantially uniform.

3. An apparatus of claim 2, wherein said header plate means substantially completely fills the cross-sectional area of said plenum means and comprises a mesh of heat resistant material.

4. An apparatus of claim 2, including means for adding the bituminous binder to the graded aggregates prior to their entering said drum mixer means and means for feeding the combined aggregates and binder to said intake region of said drum mixer means.

5. An apparatus of claim 4, including means for preventing a free flow of air into said drum mixer means through said feeding means.

6. An apparatus of claim 1, wherein said second channeling means includes means for directing the remaining portion of the exhaust gas present at said discharge region of said drum mixer means away from said heating means, and means for controlling the relative movement of said selected portion and said remaining portion of said exhaust gas.

7. An apparatus of claim 6, wherein said second channeling means includes a first branch open to the atmosphere, through which said remaining portion of the exhaust gas is directed, and a second branch connected to said interior of said heating means manifold substantially surrounding said combustion chamber, through which said selected portion of the exhaust gas is directed, said means for controlling the relative movement being a movable damper positioned in said first branch.

8. An apparatus of claim 7, including a particle separator positioned to receive exhaust gases in said second channeling means prior to the split of said second channeling means into first and second branches.

9. An apparatus of claim 1, wherein said means for maintaining a flow of heated gas is a fan positioned in said second channeling means.

10. An apparatus of claim 1, wherein said openings are located downstream of the termination point of the flame produced by said burner means during operation thereof.

11. An apparatus of claim 10, wherein said openings are louver-like, and are arranged at regular intervals in the peripheral surface of said combustion chamber.

12. An apparatus of claim 11, wherein said openings are located over an axial distance of approximately one-half of the diameter of the combustion chamber.

13. An apparatus of claim 12, wherein the total surface area of the openings is sufficient to cause a pressure drop in the selected portion of exhaust gas from said second intake means of between 1 and 4 inches of water.

14. A partially closed system for producing bituminous paving mixture comprising:

drum mixer means having an intake region in the vicinity of one end thereof and a discharge region in the vicinity of the other end thereof, said drum mixer means being operable, when fired, to produce a bituminous paving mixture at said discharge region;

means for introducing graded aggregate into said drum mixer means at said intake region;

means for introduing a bituminous binder into said drum mixer means at said intake region;

plenum means disposed at said intake region and arranged to substantially enclose the end of said drum mixer means at said intake region, the interior of said plenum means being open to the interior of said drum mixer means;

exhaust manifold means disposed at said discharge region and arranged to substantially enclose the end of said drum mixer means at said discharge region;

heating means, spaced apart from said drum mixer means, for producing a heated gas having a temperature in the range of 700 to 2000 degrees Fahrenheit;

said heating means comprising a gas-to-gas heat exchanger comprising a length of duct having a duct inlet and duct outlet at its respective ends;

a substantially sealed chamber having a chamber inlet and a chamber outlet;

said substantially sealed chamber being arranged to surround substantially all of said length of duct;

burner means for receiving fuel and ambient air and for producing a flow of heated combustion gas into said chamber inlet and around said length of duct, the temperature of any gas in said duct being heated to a desired level by the flow of heated combustion gas therearound;

said chamber outlet being vented to the atmosphere;

first channeling means for receiving heated gas from said duct outlet and directing said heated gas to the interior of said plenum means;

second channeling means communicating with the interior of said exhaust manifold for directing exhaust gases within said exhaust manifld to said duct inlet;

means for maintaining a flow of heated gas throughout said partially closed system.

* * * * *